United States Patent [19]

Ponte

[11] Patent Number: 4,826,177

[45] Date of Patent: May 2, 1989

[54] BALL AND GAME

[76] Inventor: Paul Ponte, 1093 NW. 12th Ter., Stuart, Fla. 34994

[21] Appl. No.: 175,515

[22] Filed: Mar. 31, 1988

[51] Int. Cl.[4] ..... A63B 41/00; A63B 63/08; A63B 65/00

[52] U.S. Cl. ..... 273/400; 273/58 B; 273/58 K; 273/428

[58] Field of Search ..... 273/398–402, 273/58 R, 58 K, 58 B, 58 BA, 428

[56] References Cited

U.S. PATENT DOCUMENTS

| | | | |
|---|---|---|---|
| 638,220 | 12/1899 | De Wolf | 273/398 |
| 712,159 | 10/1902 | Voege | 273/400 |
| 1,208,235 | 12/1916 | Thayer | 273/400 |
| 1,299,092 | 4/1919 | Abrahamson | 273/58 K |
| 1,433,437 | 10/1922 | Wakeham | 273/400 |
| 1,531,317 | 3/1925 | Stubbs | 273/58 B |
| 2,031,240 | 2/1936 | Van Deest | 273/58 K |
| 2,098,011 | 11/1937 | Osvold | 273/400 |
| 2,362,064 | 11/1944 | Giesinger | 273/58 K |
| 2,545,615 | 3/1951 | Hatley | 273/402 |
| 3,098,779 | 7/1963 | Cox | 273/58 B X |
| 3,755,820 | 9/1973 | Petrosek | 273/58 B X |
| 4,200,288 | 4/1980 | di Donato | 273/58 K X |

FOREIGN PATENT DOCUMENTS

| | | | |
|---|---|---|---|
| 65719 | 7/1914 | Austria | 273/400 |
| 2153703 | 5/1973 | Fed. Rep. of Germany | 273/58 R |
| 2359704 | 6/1975 | Fed. Rep. of Germany | 273/58 K |
| 109714 | 9/1917 | United Kingdom | 273/428 |
| 220970 | 9/1924 | United Kingdom | 273/400 |

OTHER PUBLICATIONS

The Way to Play, by the Diagram Group, Paddington Press Ltd. 3–1976, p. 222; Spot-Point Basketball Shoot. Kick the Can and Over 800 Other Active Games & Sports For All Ages, Hindeman, © 1956, 1955 & 1951, p. 136, in the Bowl.

*Primary Examiner*—Paul E. Shapiro

*Attorney, Agent, or Firm*—Steele, Gould & Fried

[57] ABSTRACT

A game includes a non-spherical, non-rolling ball that is used in combination with a basket supported above the playing surface by support legs. The basket has a rim defined by square, channel shaped, members defining downwardly opening grooves and the legs may be pivoted upwardly into the grooves. The basket is positioned in a playing area and a boundary is marked around the basket. The players attempt to throw the ball into the basket from a number of shooting positions around the boundary. A game ball includes an inflatable cubic bladder. A plurality of stiffeners are disposed within the bladder. The stiffeners include passages with valves that permit the passage of gases through the stiffeners to equalize pressure within chambers formed by the stiffeners.

8 Claims, 3 Drawing Sheets

BALL AND GAME

BACKGROUND OF THE INVENTION

1. Field of the Invention

This invention relates generally to games, and more particularly to ball games.

2. Description of the Prior Art

Many ball games are not well suited for play in open areas. The balls roll far from the players and must be continually retrieved. This greatly detracts from the fun of the game and is also dangerous. Children chasing the ball sometimes run into streets where passing automobiles threaten their safety.

Several games have been devised in which players throw a ball at a target. These games include basketball. Basketball requires a net mounted ten feet above the playing surface, however, and the ball must be thrown with some force to reach this height. The basket and backboard should be rigidly mounted to a heavy support, and an adequate basket and rim for basketball is generally not portable. Some players also do not have the physical ability to comfortably throw the ball to this height, and many young children, women, and older individuals cannot enjoy playing the game.

Playing areas sometimes are not paved, or are uneven and rough. This is especially the case in playgrounds, yards, and campsites. Games which require players to run are dangerous to play on these surfaces. Some games require players to bounce a ball on the playing surface, and these games are difficult or impossible to play on rough or uneven surfaces.

It would be desirable to provide a ball game which is suited for play in open areas. The game should preferably be designed to prevent children from chasing balls into streets. It further would be desirable if the game were fully portable and playable on uneven and rough surfaces. The game could thereby be played in playgrounds, yards, and campsites. The game preferably could be enjoyed by players with widely varying physical capabilities.

SUMMARY OF THE INVENTION

It is an object of the invention to provide a game which can be played by persons of varying physical capabilities.

It is another object of the invention to provide a game which is portable.

It is still another object of the invention to provide a game which can be played in open areas.

It is another object of the invention to provide a game which will not require players to continually retrieve the ball and which will thereby help to prevent children from chasing the ball into a street.

It is yet another object of the invention to provide a game which can be played on rough or uneven surfaces.

These and other objects are accomplished by a game including a non-spherical, non-rolling ball and a basket with a rim. The term "roll" as used herein is defined as the continuous contact between a surface and an object moving across the surface and rotating about an axis that, without bounce, will remain a fixed distance from the surface. The game is played by placing the basket in the center of the playing area and marking a boundary around the basket. The boundary is preferably a square with twenty foot sides. Shooting positions can be defined at substantially each midpoint and corner of the square boundary. A shooting position is chosen as the first position, and a first player attempts to throw the ball into the basket. Each successful attempt is worth a number of points, and preferably one point. Successful attempts from the corner positions can be awarded more points, preferably two points. The first player continues to shoot until the basket is missed. Succeeding players then shoot from the first position. The players move to the second position when they have missed at the first position. The players move from position to position around the boundary until each player has shot from all midpoints and corners of the square boundary. The player with the most points on completion of the circuit is declared the winner.

The ball is preferably cubic. It can be constructed from a solid material such as styrofoam but preferably is constructed as an inflatable bladder. A plurality of stiffeners can be disposed within the bladder. The stiffeners substantially span opposing sides of the cubic bladder to provide a ball with the feel of an inflated ball but also the stiffness to retain shape and avoid excessive bounce. The cubic ball does not roll. Errant throws which miss the basket do not travel far from the basket and the ball generally does not leave the playing area. The game therefore does not require the players to continually retrieve the ball and does not endanger children who might otherwise chase the ball into the street. The ball and basket can be made of lightweight materials and therefore are completely portable. Contact with the ground is not a part of the game, and therefore the game can be played on virtually any playing surface. The game also does not require the players to run over the playing surface and, therefore, can be played on rough or uneven surfaces.

The stiffeners preferably are substantially planar and extend between opposing sides of the cubic bladder to form internal chambers within the bladder. Gas passages are provided in the stiffeners to permit air or another gas injected through a valve into one of the chambers of the bladder to pass through the stiffeners to inflate all interior chambers of the bladder. The passages can include valve structure movable between an open position, permitting the air to flow through the passage, and a closed position substantially blocking the passage. The valve can be conveniently formed as a flap pivotally mounted over the passage.

The basket preferably includes a rim that is supported above the playing surface by a suitable support such as a plurality of legs. The basket can have a net that is preferably closed such that balls thrown through the rim will be retained in the net and the ball will not have to be retrieved. The rim is preferably square to add to the "square" theme of the game. A leg is provided at each corner of the square rim. The legs are pivotally mounted to the rim such that they fold up along side the rim for convenient carrying and storage. In one embodiment, the rim is formed from channel members and the legs fold up into the channels for still greater convenience. The legs can be locked in the folded position by forming the channel member from an expandable material and by dimensioning the legs to press-fit into the channels.

BRIEF DESCRIPTION OF THE DRAWINGS

There are shown in the drawings embodiments which are presently preferred it being understood, however, that the invention is not limited to the precise arrangements and instrumentalities shown, wherein.

DETAILED DESCRIPTION OF THE PREFERRED EMBODIMENTS

Figure 1:
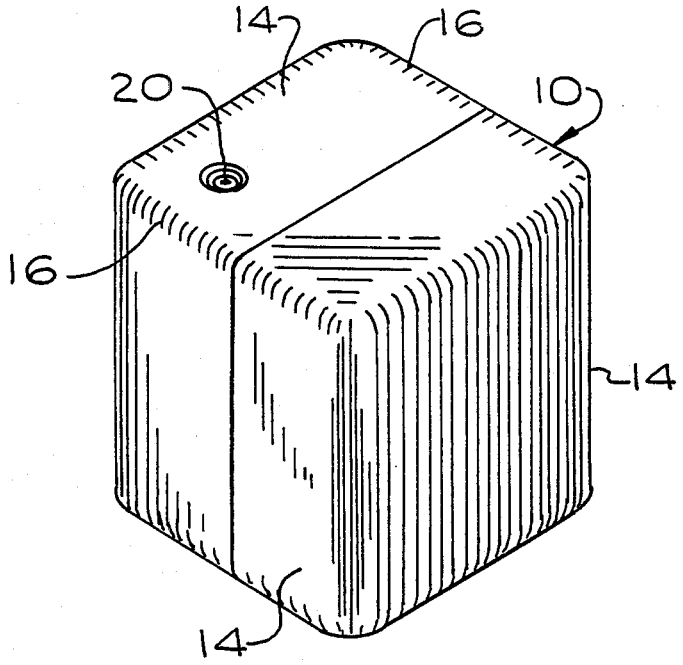
FIG. 1 is a perspective of the ball according to the invention.
Figure 2:
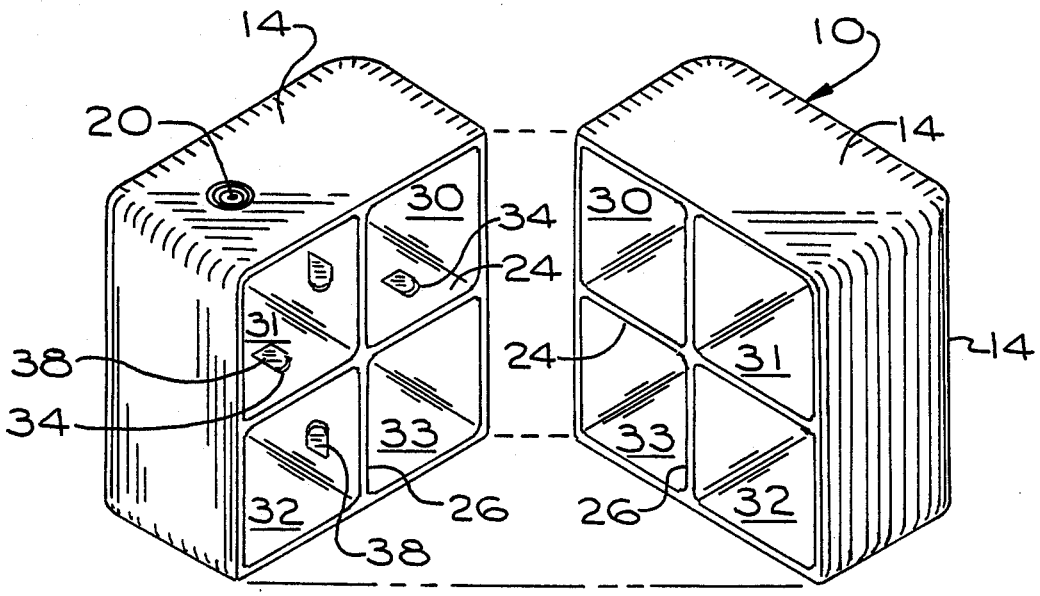
FIG. 2 is an exploded perspective of the ball.

A game ball according to the invention is cubic in shape, as shown in FIGS. 1-2. The game ball 10 includes six sides 14. The sides 14 are preferably flexible and joined together at edges 16 thereof to form a flexible bladder. Air or other gases can be sealed within the bladder to provide a ball which is both light and of sufficient size to be easily handled. An inflating apparatus of suitable design can be used to inflate the ball through a valve 20 to maintain a desired level of inflation.

The ball 10 includes a plurality of stiffeners enclosed within the bladder and adapted to maintain the bladder's cubic shape, as well as to give the flexible ball a degree of rigidity that will resist bouncing. The stiffeners are preferably planar and substantially span the distance between opposing sides 14 of the cubic bladder 10. A first planar stiffener 24 can be positioned within the ball 10 to substantially divide the interior space of the ball in half. A second planar stiffener 26 can be provided substantially perpendicular to the first planar stiffener 24 and preferably bisects the first planar stiffener 24.

The planar stiffeners 24 and 26 form four interior compartments 30-33. The planar stiffeners 24 and 26 will normally seal the interior compartments 30-33 and prevent the passage of air or another inflating gas from the valve 20 to all of these compartments. It is therefore desirable to provide passages to permit the air to travel between the interior compartments. The passages preferably include valves to maintain equal pressures between the compartments 30-33. One or more apertures 34 can be provided in each half of the planar stiffeners 24 to permit the circulation of the air or other inflating gas. Valve means can be associated with the apertures 34. A flap 38 can be pivotally mounted over the aperture 34. The flap 38 is movable between a first position in which it substantially blocks the flow of gas through the aperture and a second position in which it is moved away from the aperture 34 and permits the flow of gas or air. Movement of the flap is controlled by the difference in pressure between chambers on opposite sides of the passage, so that pressures within the chambers 30-33 will tend to equalize.

Figure 3:
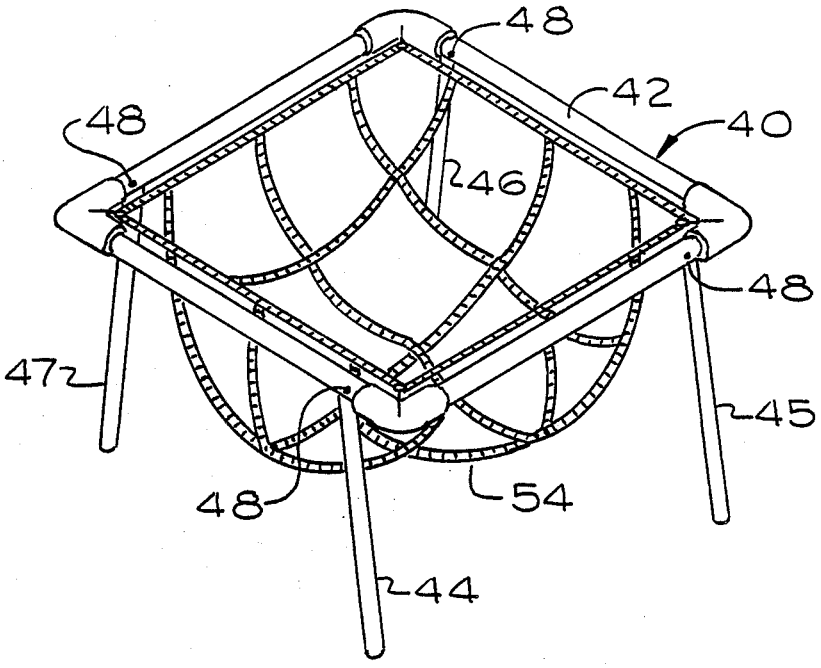
FIG. 3 is a perspective of a basket according to the invention.
Figure 4:
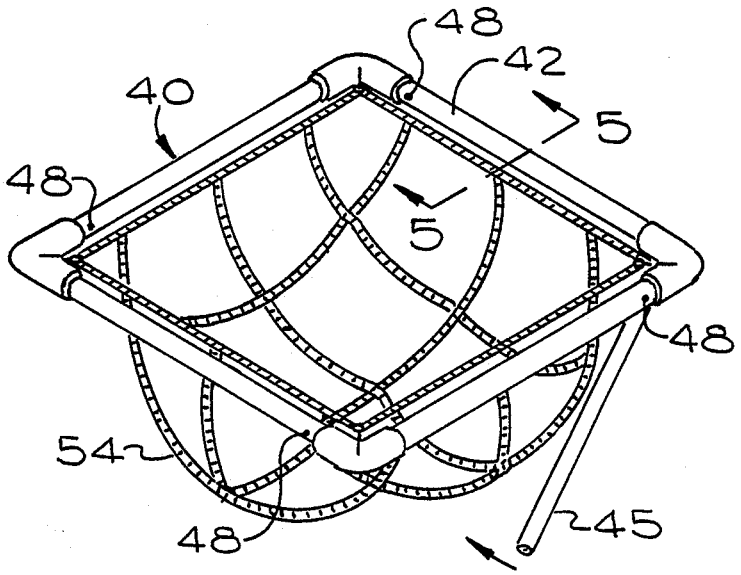
FIG. 4 is a perspective of the basket in an alternative configuration.
Figure 5:
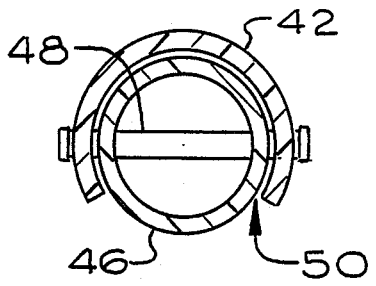
FIG. 5 is a cross-section taken along line 5—5 in FIG. 4.

A basket for the game is shown in FIGS. 3-5. The basket 40 includes a rim 42 supported above the playing surface by a plurality of legs 44-47 spaced about the rin 42. The legs 44-47 can be fashioned in various dimensions but are preferably about fifteen inches long. The rim of the basket is preferably no more than three feet above the surface. The legs 44-47 preferably have ends pivotally mounted to the rim 42 about hinge pins 48 such that the legs 44-47 have a first, extended position substantially perpendicular to the rim 42 in which the legs 44-47 support the rim 42 above a playing surface (FIG. 3). The legs 44-47 preferably pivot into the extended position slightly past the vertical (FIG. 3) to retain them in the extended position. A second, folded position of the legs 44-47 places them substantially adjacent to the rim 42 for convenient carrying and storage (FIG. 4).

The rim 42 can be made from a downwardly opening channel member which defines a groove 50 (FIG. 5). The legs 44-47 pivot (arrow in FIG. 4) into the groove 50 for still greater convenience. The groove 50 is preferably semi-circular, and at least a half circle in cross section. The rim 42 can be made of a flexible material and dimensioned such that the legs 44-47 press-fit into the groove 50 to lock the legs 44-47 in the folded position.

A net 54 preferably depends from the rim 42. The net 54 preferably is closed such that balls thrown through the rim 42 are retained by the net 54 and need not be chased by the players.

Figure 6:
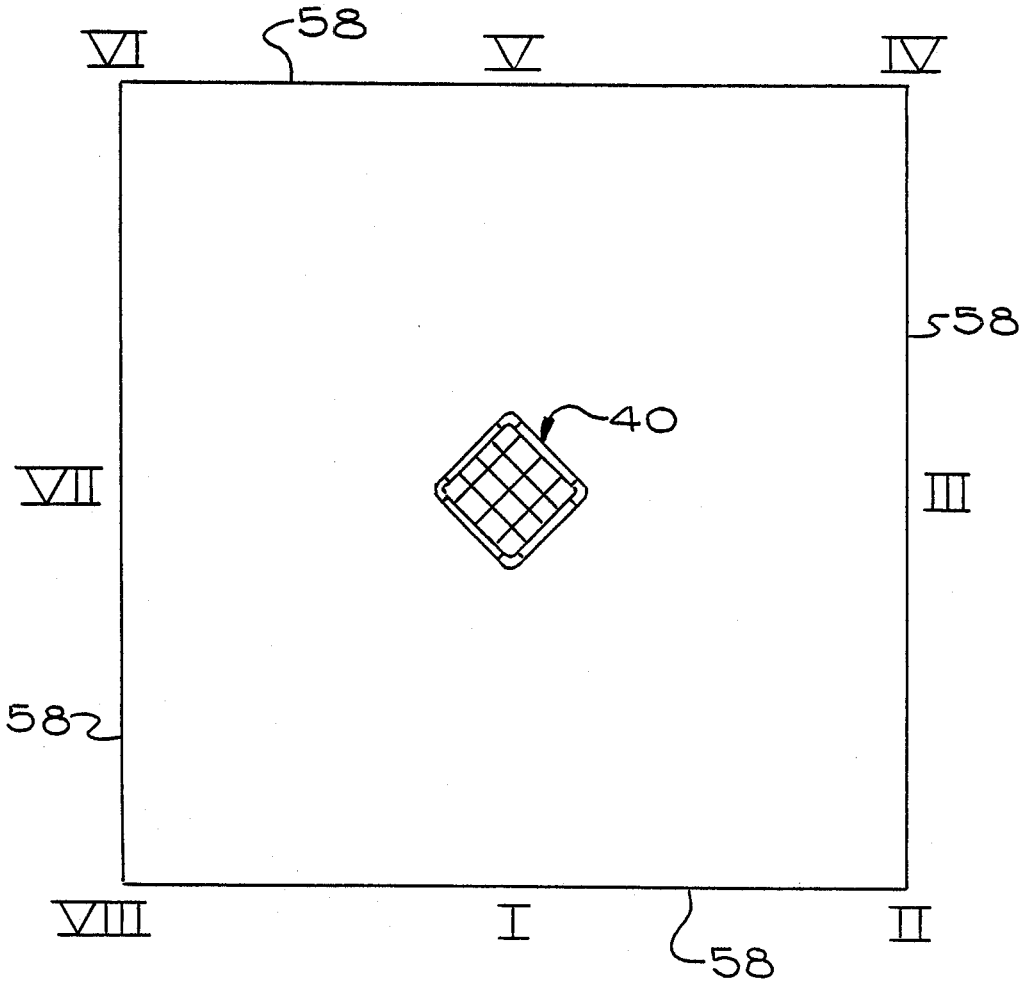
FIG. 6 is a schematic of the court for playing the game.

The game is played by first positioning the basket 40 in the center of the playing area. A perimeter is marked, preferably in the shape of a square as shown in FIG. 6. The sides 58 can be indicated by chalk lines, string, or any means at hand suitable for this purpose. The sides 58 are preferably about twenty feet long. The first player stands at position I (or any other chosen position) and attempts to throw the ball into the basket 40. The player is awarded points for each successful attempt, preferably one point, and shoots from the same position until the player misses. When the player misses, the player moves to position II and attempts again to throw the ball into the basket 40. Successful attempts from the corner positions (II, IV, VI, VIII) are preferably worth more points than successful attempts from the side positions (I, III, V, VII). Successful attempts from the corner positions can be worth two points. The players move about the square boundary until all players have attempted throws from all eight positions. The player who has accumulated the most points through the eight position circuit is declared the winner of the game.

The game can be played over virtually any playing surface, as the players do not run across the surface and the ball is not bounced on the surface. The game can be played in virtually any open area—at campsites, in playgrounds, or in the yard. Errant shots will not roll far from the basket due to the square shape of the ball. The necessity of chasing after the ball, and the danger of children running into busy streets, is thereby reduced. The basket and ball are portable and readily carried from one playing site to another, or returned to storage.

The game can be played with several modifications to the ball, basket, and rules of the game without departing from the spirit or essential attributes thereof, and accordingly, reference should be made to the following claims rather than to the foregoing specification as indicating the scope of the invention.

I claim:

1. A game, comprising:

a game ball having a non-spherical shape adapted to retard rolling; and a basket having a rim, the rim having support structure comprising a plurality of legs adapted to support the rim above a playing surface, the legs being pivotally mounted at an end thereof to the rim, the rim being substantially square-shaped and formed from channel members defining downwardly opening grooves, said legs folding upward into said grooves for convenient carrying and storage, and means for retaining said legs in said grooves, whereby the ball can be thrown with the object of passing the ball through the rim, and the non-spherical shape will retard rolling when the ball contacts the playing surface.

2. The game of claim 1, wherein said channel members are substantially at least half-circular in cross-section and fashioned from a flexible material, at least a portion of said legs substantially matching in cross-section said grooves, whereby said legs will press-fit into said channel members when in the folded position.

3. The game of claim 1, wherein said ball is cubic and constructed from an inflatable bladder.

4. The game of claim 3, wherein a plurality of stiffeners are provided within said ball, said stiffeners substantially spanning opposing sides of said cubic bladder, whereby said cubic bladder will maintain its cubic shape when inflated.

5. The game of claim 4, wherein said stiffeners comprises valve means permitting the passage of gases.

6. A ball for playing games, comprising:

an inflatable cubic bladder, a plurality of stiffeners being disposed within said bladder, said stiffeners substantially spanning opposing sides of said cubic bladder, said stiffeners defining chambers within said inflatable cubic bladder, said stiffeners comprising means for permitting the passage of gases through said stiffeners, said gas passage means comprising valve means; and, valve means in said bladder, said valve means being adapted to permit the selective introduction of air or other gas into said inflatable bladder;

whereby said cubic shape of said ball will substantially retard rolling across a playing surface and said stiffeners will retain said cubic shape, and whereby said gas passage valves will substantially equalize pressure within the chambers.

7. The ball of claim 6, wherein said gas passage valve means comprises at least one aperture through said stiffeners, and closure means associated with said aperture and movable between a first position substantially blocking the flow of gas through the aperture and a second position permitting the flow of gas through the aperture, movement of the closure means between the first and second positions being controlled by the difference in gas pressure on opposite sides of said stiffeners.

8. The ball of claim 7, wherein the closure means is a flap pivotally mounted over the aperture.

* * * * *

UNITED STATES PATENT AND TRADEMARK OFFICE

CERTIFICATE OF CORRECTION

PATENT NO. : 4,826,177

DATED : May 2, 1989

INVENTOR(S) : Paul Ponte

It is certified that error appears in the above-identified patent and that said Letters Patent is hereby corrected as shown below:

Column 3, line 60, delete "rin" and insert --rim--.

Signed and Sealed this

Nineteenth Day of November, 1991

*Attest:*

HARRY F. MANBECK, JR.

*Attesting Officer*

*Commissioner of Patents and Trademarks*